US006394112B1

(12) United States Patent
Steinmetz et al.

(10) Patent No.: US 6,394,112 B1
(45) Date of Patent: May 28, 2002

(54) PIPE CLEANING NOZZLE

(75) Inventors: Uwe Steinmetz, Wiesbaden; Steffen Zang, Aschaffenburg; Thomas Dittmar, Wiesbaden; Karlheinz Steinmueller, Alzey, all of (DE)

(73) Assignee: Lufthansa Technik AG, Hamburg (DE)

( * ) Notice: Subject to any disclaimer, the term of this patent is extended or adjusted under 35 U.S.C. 154(b) by 0 days.

(21) Appl. No.: 09/532,441

(22) Filed: Mar. 23, 2000

(30) Foreign Application Priority Data

Mar. 26, 1999 (DE) ..... 199 13 728

(51) Int. Cl.[7] ..... B08B 3/00

(52) U.S. Cl. ..... 134/167 C; 134/166 C; 134/168 C; 134/169 C

(58) Field of Search ..... 134/167 C, 166 C, 134/168 C, 169 C; 15/320, 321; 18/72

(56) References Cited

U.S. PATENT DOCUMENTS 1,587,194 A * 6/1926 Sladden ..... 134/167 C
3,656,694 A * 4/1972 Kirschke ..... 239/533
4,216,738 A * 8/1980 Muta ..... 239/533
4,764,180 A * 8/1988 Shaddock ..... 29/157 C
4,819,314 A * 4/1989 Shaddock ..... 29/157 C
5,241,723 A * 9/1993 Garrabrant ..... 15/316.1
5,992,432 A * 11/1999 Horger et al. ..... 134/167 C

FOREIGN PATENT DOCUMENTS

DE 40 13 547 A1 * 10/1991 ..... 134/167 C
DE 19913728 3/1999

* cited by examiner

*Primary Examiner*—Sharidan Carrillo
*Assistant Examiner*—Joseph Perrin
(74) *Attorney, Agent, or Firm*—Diller, Ramik & Wight

(57) ABSTRACT

The pipe cleaning nozzle is designed for the removal of deposits (23) in vacuum toilet pipes, particularly such pipes in aircraft, ships and trains. Since pipes (10) of this type are often installed to follow narrow radii of curvature, a need exists for a pipe cleaning nozzle which has a small axial dimension. The nozzle head (12) comprises a convex front wall (16) and a concave rear wall (17). The connector piece (13) is partially sunk in the concave rear wall (17). The high-pressure jets (22) are discharged from the nozzle orifices (21) to split off the deposits. The overall length of the nozzle head (12) inclusive of the connector piece (13) is not larger than the outer diameter of the nozzle head.

4 Claims, 2 Drawing Sheets

FIG.1
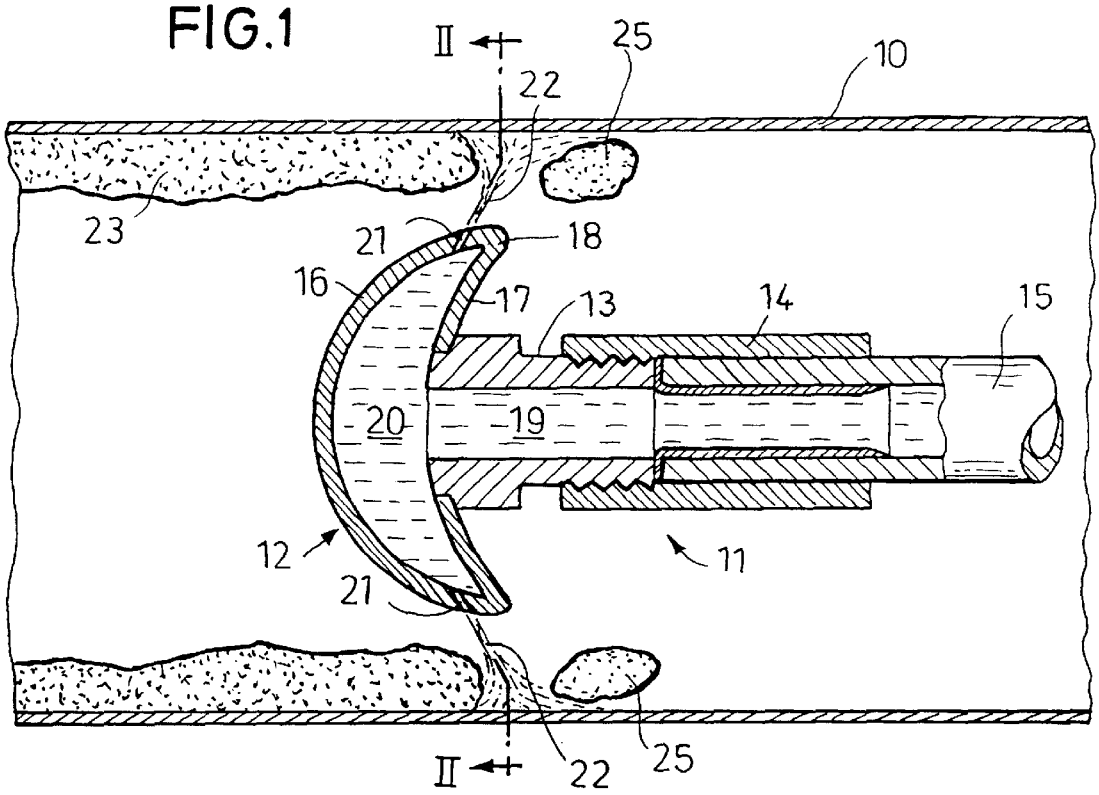
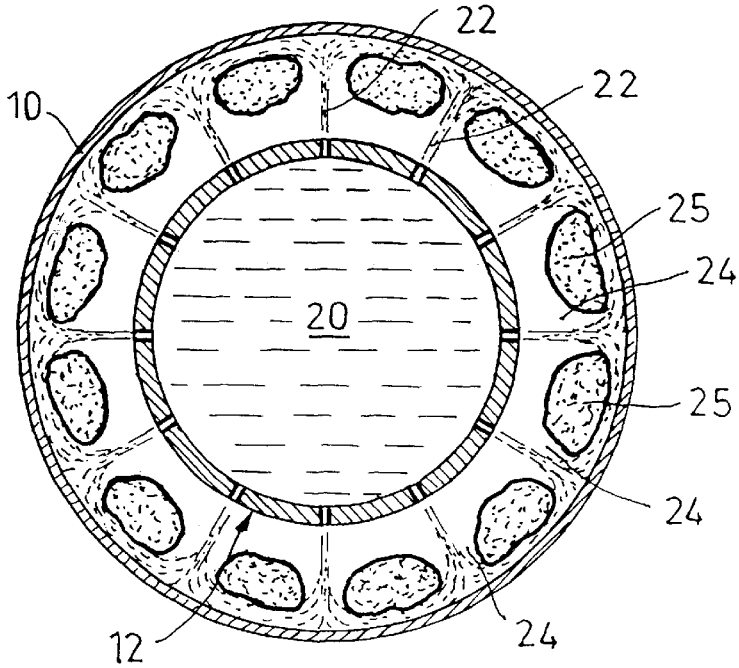
FIG.2

PIPE CLEANING NOZZLE

The present invention relates to a pipe cleaning nozzle for the cleaning of pipe conduits, particularly of pipe conduits in toilet systems of aircraft, by use of a pressurized cleaning jet.

BACKGROUND OF THE INVENTION

Pipe conduits for sanitary waste water tend to become soiled by impurities and deposits of urinary sediments which considerably affect the functioning of the toilet system. Thus, pipe conduits of the above type have to be cleaned in certain intervals. German Patent 197 03 317 A1 describes a pipe cleaning nozzle which is subjected to a pressure of about 400 bar to 420 bar. The nozzle orifices, directed toward the outside, are configured to eject pressurized jets with high kinetic energy to destroy and wash off the impurities attached to the pipe wall. The pipe cleaning nozzle comprises a nozzle head which is by a few millimeters smaller than the free cross section of the pipe so that the pressurized jets will impinge on the deposits with high energy. The pressurized jets, largely oriented in radial directions, have rearward axial component provided to generate the advance movement of the nozzle head in the pipe conduit. In this manner, the nozzle head will move through the pipe conduit to be cleaned, while taking along the high-pressure hose connected thereto for supply of the cleaning liquid.

Aboard aircraft, ships or trains, the toilet pipes connected to a vacuum source have diameters in the range of 50 mm. These toilet pipes can have a length of 70 to 100 m, and their course has to follow small-radiused bends and curves. Further, such pipes conduits include portions where the pipes are guided horizontally or vertically. Cleaning work to be carried out on such pipes is extremely difficult.

It is an object of the invention to provide a cleaning nozzle which is suited particularly for the cleaning of vacuum toilet pipes which have a small cross section and have been laid to follow narrow curves.

SUMMARY OF THE INVENTION

The cleaning nozzle according to the instant invention comprises a concave rear wall having its deepened portion provided with the connector piece for the high-pressure hose. Thus, the nozzle head has an extremely short constructional length. A part of the length of the connector piece has been sunk, as it were, into the nozzle head so that the overall length of the combined nozzle head and connector piece can be kept short. Since the connector piece and the nozzle head form a rigid unit, the length of this unit will determine the smallest radius of curvature of the pipe that would still allow the passage of the cleaning unit. The outer diameter of the nozzle head is about twice as large as the outer diameter of the connector piece, so that, on the one hand, the nozzle orifices will come close to the pipe wall while, on the other hand, the connector piece can be given the smallest possible diameter.

Preferably, the nozzle head has a convex front wall. The convex front wall and the concave rear wall together have a shape similar to that of a mushroom head. Arranged inside the nozzle head is the distributor chamber for the pressurized fluid while the nozzle orifices are arranged on a circumferential portion which has a relatively large diameter as compared to the diameter of the connector piece.

Preferably, the front wall and/or the rear wall are formed as spherical shells.

The instant invention further relates to a method for the cleaning of pipe conduits by use of a pipe cleaning nozzle comprising a connector piece and nozzle orifices, with the nozzle orifices directed radially outwards and having an axial component oriented in the direction of the connector piece. According to a characteristic aspect of the instant method, that pipe portion which is facing away from the connector piece, is connected to a suction source for the removal of detached deposits. This means that the cleaning jets are discharged from the nozzle head with a rearward component while the suction source performs the suctional removal in the forward direction. The term "forward" in the present context is meant to denote the moving direction of the pipe cleaning nozzle during the advance movement, wherein the advance movement is generated by the recoil effect of the discharged cleaning jets. The mixture of cleaning liquid and deposits is positively drained in the direction opposite to the direction of the detachment.

An embodiment of the invention will be described in greater detail hereunder with reference to the drawings.

BRIEF DESCRIPTION OF THE DRAWINGS

FIG. 1 is a longitudinal sectional view of a pipe conduit with the pipe cleaning nozzle arranged therein, FIG. 2 is a sectional view along the line II—II in FIG. 1.

DETAILED DESCRIPTION OF A PREFERRED EMBODIMENT

Figure 3:
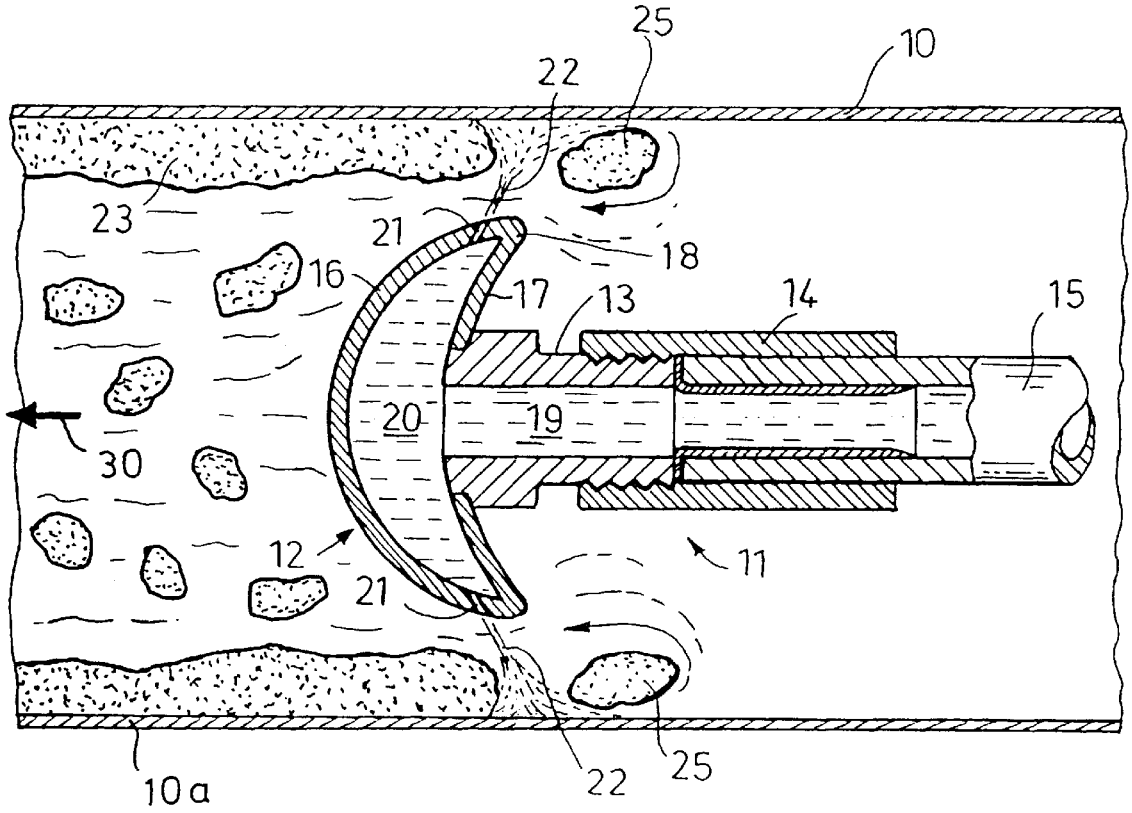
FIG. 3 is a view similar to FIG. 1, illustrating the pipe cleaning process performed with simultaneous suctional removal.

FIG. 1 illustrates a pipe 10 to be cleaned, which pipe is a vacuum toilet pipe of an aircraft. The pipe diameter is about 50 mm, and the wall thickness is about 0.4 mm. The pipe is made of titanium.

A pipe cleaning nozzle 11 is moved internally through pipe 10. Pipe cleaning nozzle 11 comprises a nozzle head 12 formed as a hollow body with a connector piece 13 axially projecting therefrom. Connector piece 13 has a threaded sleeve 14 mounted thereon by threaded engagement which is part of a hose coupling being in turn connected to the end of a flexible high-pressure hose 15. High-pressure hose 15 has an inner diameter of 6 mm and a wall thickness of 4 mm. The hose is a rubber hose with an two-layered steel lining internally thereof.

Nozzle head 12 comprises a convexly shaped partial-spherical front wall 16 and a concavely shaped, likewise partial-spherical rear wall 17. Front wall 16 and rear wall 17 are connected to each other by welding on an outer edge 18. The connector piece 13 is welded to the center of rear wall 17. Connector piece 13 has a liquid channel 19 extending therethrough, arranged to lead into the internal chamber 20 of nozzle head 12. Thus, nozzle head 12 has a sickle-shaped longitudinal section.

The circumferential edge of front wall 16 is formed with tubular nozzle orifices 21 which are directed radially outward but are oriented to have an axial rearward component. Nozzle orifices are arranged at an angle of 20° to 25° relative to the radial plane of the nozzle head. Each nozzle orifice is provided for discharge of a high-pressure jet 22 which is directed against pipe wall 10 to destroy and wash off deposits 23 attached to wall 10.

As evident from FIG. 2, the high-pressure jets 22 will generate longitudinal grooves 24 in the deposits 23, thus separating the remaining deposits 25 from each other. These residual deposits 25 are underwashed according to FIG. 1 and will finally also become detached from the pipe wall.

High-pressure hose 15 is connected to a high-pressure pump (not illustrated) designed to have a feed pressure of 400 to 420 bar and to deliver a conveying quantity of 64 liters/min. Nozzle had 12 is made from stainless steel. For the pipe conduit 11 with the described dimensions, nozzle heads are available in two sizes, notably with an outer diameter of 33 mm and an outer diameter of 43 mm, with the wall thickness being 2.3 mm in each case. The choice of the nozzle head in the respective case will depend on the thickness of the deposits 23. Nozzle head 12 presents a number of 8–24 circumferentially distributed nozzle orifices which have a total cross section of 6 to 7 $mm^2$.

The constructional length of the pipe cleaning nozzle comprising nozzle head 12 and connector piece 13 is at maximum roughly as large as the outer diameter of the nozzle head.

FIG. 3 is a view of the above described pipe cleaning nozzle during the cleaning process with vacuum suction. A suction source is connected to that pipe portion 10*a* which is facing away from connector piece 13 so that the suctional removal is performed in the direction of arrow 30. From FIG. 3, it can be seen that the high-pressure 22 jets are directed axially rearwards (to the right-hand side in the FIG. 3) and underwash the deposits 23. The suction effect forces the mixture of cleaning water and the deposits to flow off in the opposite direction, i.e. in the forward direction, into a collector tank. This feature also obviates the need to have the impurities flow through the already cleaned pipe portion. The vacuum pump delivers a vacuum pressure of 0.1 to 0.3 bar with a conveying quantity of 15 $m^3$/h.

We claim:

1. A pipe cleaning nozzle for pressure-jet cleaning a conduit comprising a nozzle head (12), said nozzle head (12) including a chamber (20) defined by an outwardly convexly curved front wall (16) having a forward leading wall portion relative to the direction of travel of the nozzle head (12) relative to an associated conduit and an opposite outwardly concavely curved trailing rear wall (17), said outwardly convexly curved front wall (16) and said opposite outwardly concavely curved rear wall (17) merging with each other at a peripheral outer edge (18), a tubular connector (13) connected substantially centrally of said concavely curved rear wall (17) and being in fluid communication with said chamber (20), said outwardly convexly curved front wall (16) having nozzle orifices (21) located adjacent and peripherally along said outer edge (18) opening into said chamber (20), and said nozzle orifices each defining a fluid exit axis from said chamber (20) oriented substantially radially outwardly and rearwardly for effecting pressure-jet cleaning of and advance movement of the nozzle head (12) relative to an associated conduit.

2. The pipe cleaning nozzle as defined in claim 1 wherein said nozzle orifices (21) are substantially equally spaced from each other.

3. The pipe cleaning nozzle as defined in claim 1 wherein said nozzle orifices (21) are in substantially radial symmetry relative to a central axis of said nozzle head (12).

4. The pipe cleaning nozzle as defined in claim 2 wherein said nozzle orifices (21) are in substantially radial symmetry relative to a central axis of said nozzle head (12).

* * * * *